United States Patent [19]

Morita et al.

[11] Patent Number: 4,727,844

[45] Date of Patent: Mar. 1, 1988

[54] APPARATUS FOR CONTROLLING IDLING SPEED OF MOTOR VEHICLE ENGINE

[75] Inventors: Kiyomi Morita, Katsuta; Junji Miyake, Mito, both of Japan

[73] Assignee: Hitachi, Ltd., Tokyo, Japan

[21] Appl. No.: 36,375

[22] Filed: Apr. 9, 1987

[30] Foreign Application Priority Data

Apr. 9, 1986 [JP] Japan ..... 61-81649

[51] Int. Cl.[4] ..... F02B 3/00

[52] U.S. Cl. ..... 123/480; 123/478; 123/339

[58] Field of Search ..... 123/339, 480, 478

[56] References Cited

U.S. PATENT DOCUMENTS

| | | | |
|---|---|---|---|
| 4,479,186 | 10/1984 | Takao | 123/480 |
| 4,508,075 | 4/1985 | Takao | 123/480 |
| 4,604,703 | 8/1986 | Hasegawa | 123/339 |
| 4,658,782 | 4/1987 | Lefevre | 123/339 |

*Primary Examiner*—Ronald B. Cox

*Attorney, Agent, or Firm*—Antonelli, Terry & Wands

[57] ABSTRACT

Disclosed is an apparatus for controlling at the time of idling the rotational speed of an engine having an injector for injecting fuel in proportion to the width of an input pulse. The control apparatus includes: a rotational speed sensor for cyclically detecting the rotational speed of the engine; an airflow meter for cyclically detecting the quantity of air being sucked into the engine; an idle switch for detecting the complete closing of a throttle valve; a judging means for judging that the engine is in the idling condition on the basis of the output of the idle switch and the output of the rotational speed sensor; and an operating means for cyclically outputting the injector a fuel injection pulse having a pulse width obtained by the following expression on the basis of the output of the rotational speed sensor and the output of the airflow meter when the judging means has judged that the engine is in the idling condition.

$$Tp_1 = k(Qa_1/N_1)\cdot\alpha + Tp_0\cdot(1-\alpha)$$

$Tp_1$: width of a pulse to be output at the present time $Tp_0$: width of a pulse which was output the previous time $Qa_1$: presently detected value for the quantity of air being sucked in $N_1$: presently detected value for the rotational speed of the engine $\alpha$: filter constant $0<\alpha<1$ k: constant

3 Claims, 4 Drawing Figures

APPARATUS FOR CONTROLLING IDLING SPEED OF MOTOR VEHICLE ENGINE

BACKGROUND OF THE INVENTION

1. Field of the Invention

The present invention relates to an apparatus for controlling the idling of an engine, and more particularly, to a controlling apparatus for reducing variation in the rotational speed of an engine at the time of idling.

2. Description of the Prior Art

In an engine control system which employs a fuel injector as a means for supplying an engine with fuel, the quantity of air being sucked into an engine and the rotational speed of the engine are detected periodically, and the amount of fuel to be supplied to the engine is determined on the basis of the so detected values. The amount of fuel to be supplied is controlled by controlling the width of pulses that make commands regarding the injection of fuel to the fuel injector. The pulse width Tp is obtained by dividing the detected quantity Qa of air by the detected engine speed N. It therefore shows a change in accordance with variations in the quantity of air being sucked in.

The rotational speed of a motor vehicle engine at the time of an idling is as low as approximately 800 rpm, and the air being sucked in at such time has a pulsation. Detection of the quantity of air being sucked into the engine is performed periodically on this pulsating air, and the quantity of air detected accordingly fluctuates considerably. If the detected value representing the quantity of air being sucked in is used as it is to calculate the fuel injection pulse width, the pulse width shows large variations, thereby causing the rotational speed of the engine to fluctuate considerably in accordance with the pulsation in the quantity of air being sucked in. This fluctuation in the engine speed causes vibration or swell, and generates noise. Attempts have therefore been made to reduce variation in the detected values by conducting filtering of the detected values for the quantity of air being sucked in. However, although the variation in the detected values representing the quantity of air being sucked in is reduced through filtering, the detected values representing the engine speed still vary, and the variations in the fuel injection pulse width cannot be reduced. Thus variation in the rotational speed of the engine cannot be adequately reduced and vibration and noise is accordingly generated.

SUMMARY OF THE INVENTION

Accordingly, an object of the present invention is to provide an apparatus for controlling idling speed which is capable of reducing variation in the rotational speed of an engine at the time of idling of motor vehicle engine.

To this end, there is provided an apparatus for controlling idling speed of an engine having a fuel injector for injecting fuel in proportion to the width of an input pulse, which comprises: a rotational speed sensor for cyclically detecting the rotational speed (N) of the engine; an airflow meter for cyclically detecting the quantity (Qa) of air being sucked into the engine; an idle switch for detecting the complete closing of a throttle valve; a judging means for judging whether or not the engine is in an idling condition on the basis of the output of the idle switch and the output of the rotational speed sensor; and an operating means for cyclically outputting to the injector a fuel injection pulse having a width (Tp) obtained by the following expression on the basis of the output of the rotational speed sensor and the output of the airflow meter when it has been determined by the judging means that the engine is in the idling condition.

$$Tp_1 = k(Qa_1/N_1)\cdot\alpha + Tp_0\cdot(1-\alpha)$$

$Tp_1$: width of pulse to be output at the present time $Tp_0$: width of pulse which was output the previous time $Qa_1$: presently detected value for the quantity of air being sucked in $N_1$: presently detected value for rotational speed of the engine $\alpha$: filter constant, $0<\alpha<1$ k: constant filter constant $\alpha$ is an arbitrary value. It is preferable that $\alpha$ be 0.125.

DETAILED DESCRIPTION OF THE PREFERRED EMBODIMENTS

Figure 1:
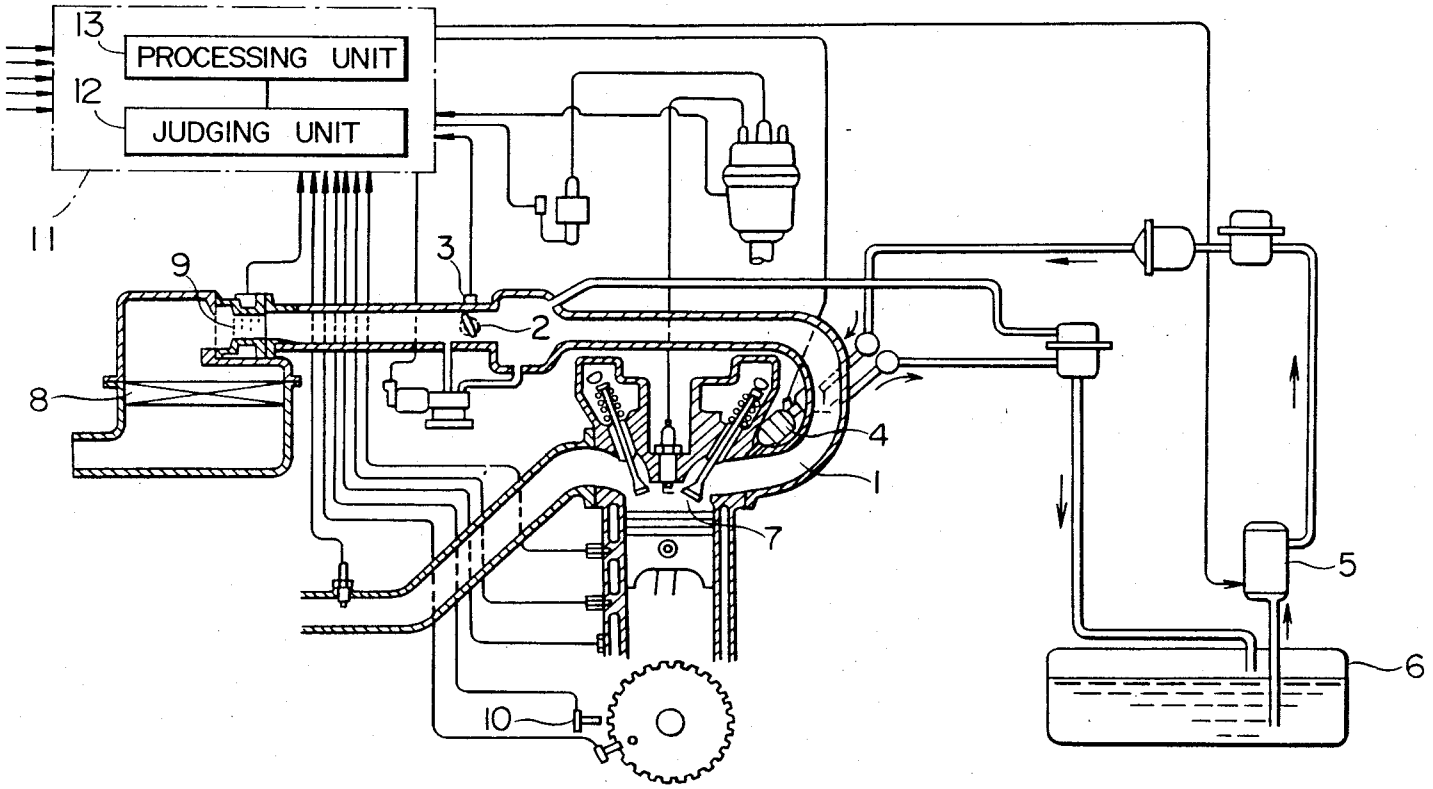
FIG. 1 is a schematically and diagrammatically view showing an engine control system which incorporates a control apparatus of this invention.

FIG. 1 shows an engine system incorporating a control apparatus of this invention. The inlet of an intake pipe 1 through which air is sucked into an engine is provided with an air filter 8. Beyond the air filter 8 is provided an airflow meter 9 for detecting a quantity of air being sucked in. Beyond the airflow meter 9 are provided a throttle valve 2 for adjusting the quantity of air being sucked in and an idle switch 3 for detecting the complete closing of the throttle valve 2. The engine is provided with a fuel injector 4 for injecting fuel into a cylinder 7, to which a fuel pump 5 for supplying fuel contained in a fuel tank 6 is connected. A rotational speed sensor 10 for detecting the rotational speed of the engine is mounted in the vicinity of the crank-shaft of the engine. The engine control system also includes a control unit 11 for cyclically outputting a pulse signal which make commands regarding the injection of fuel to the fuel injector 4 on the basis of the outputs of the airflow meter 9 and rotational speed sensor 10. The control unit has a judging unit 12 for judging whether or not the engine is in the idling condition, and an operating unit 13 for outputting a pulse to the fuel injector 4 when the engine is in the idling state.

The judging unit 12 determines that the engine is in the idling condition when the output of the idle switch 3 indicates the complete closing of the throttle valve 2 and the output of the rotational speed sensor 10 is a value which is smaller than a previously stored predetermined value. The operating unit 13 calculates a pulse to be output of the fuel injector on the basis of the values detected by the airflow meter 9 and rotational speed sensor 10 when the engine is in the idling condition.

Generally, the width of a pulse to be output to the fuel injector 4, i.e., a time Tp, is expressed by the following expression.

$$Tp=k(Qa/N)$$

where Qa is the quantity of air being sucked into the engine, N, the rotational speed of the engine, and k, constant.

In the prior art, filtering is performed on the detected values for the quantity Qa of air being sucked in, while in the present invention the pulse time Tp obtained by the above-described expression, i.e., the result of the division, Qa/N, is filtered. More specifically, the time of the pulse to be output at the present time is obtained as follows: the pulse time obtained from the values detected at the present time by the airflow meter 9 and the rotational speed sensor 10 is increased $\alpha$-fold, and this value is added to a value obtained by increasing the pulse time which was output the last time $(1-\alpha)$-fold. This is expressed as follows:

$$Tp_1=k(Qa_1/N_1)\cdot\alpha+Tp_0\cdot(1-\alpha)$$

$Tp_1$: time of pulse to be output at the present time $Tp_0$: time of pulse which was output the previous time $Qa_1$: quantity of air being sucked as detected the present time $N_1$: rotational speed as detected the present time $\alpha$: filter constant, $0<\alpha<1$.

The filter constant is a value which satisfies $0<\alpha<1$, and which is set in accordance with a desired engine response. This means that the larger the value $\alpha$, the closer the time of a pulse to be output at the present time to the time of a pulse which is determined on the basis of the presently detected value for the quantity Qa of air being sucked in and the presently detected value for the rotational speed N of the engine.

Figure 2:
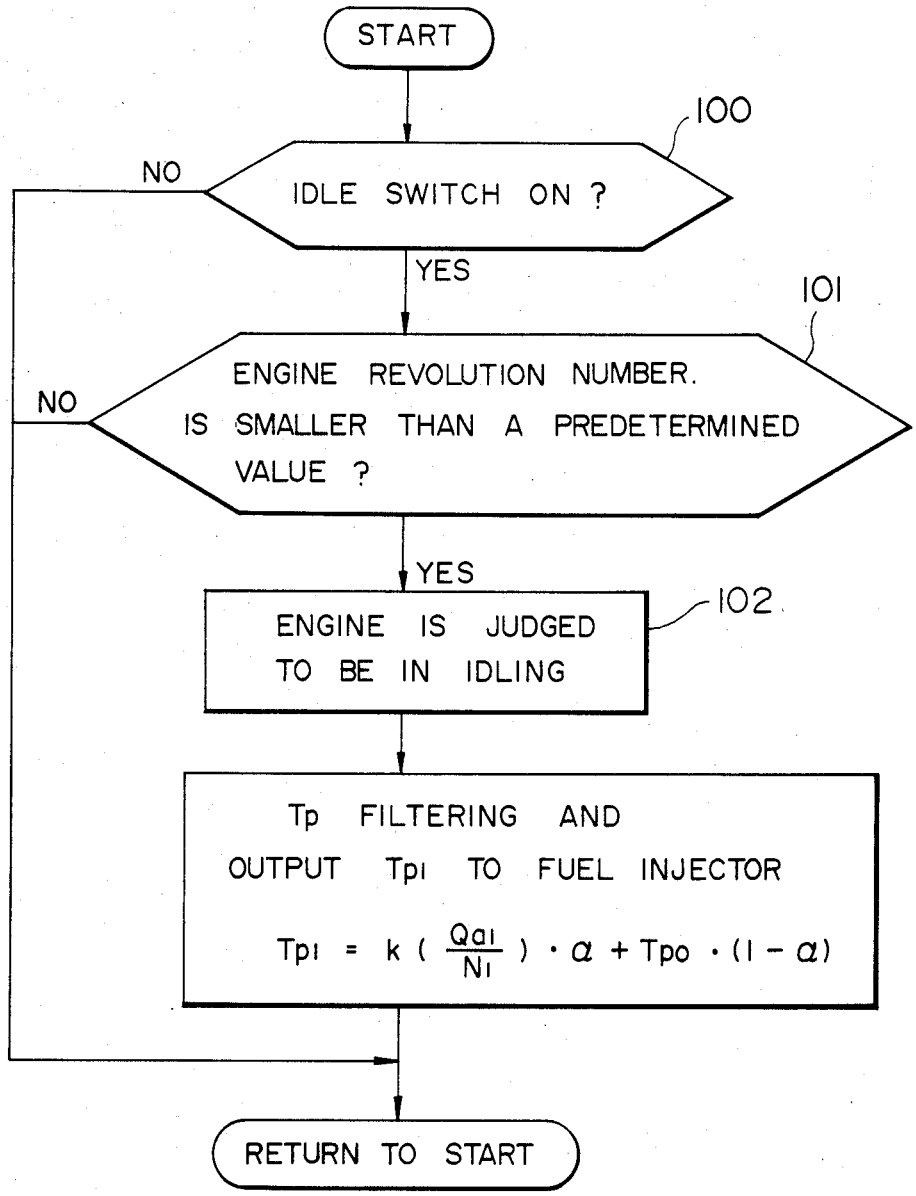
FIG. 2 is a flowchart of the control routine of the control apparatus of this invention.

The operation of the control apparatus will be described below by referring to FIG. 2.

In Step 100, a judgement is made as to whether or not the idle switch 3 is ON. If the idle switch 3 is ON, the procedure goes to Step 101 in which it is judged whether or not the engine rotational speed is smaller than a predetermined rotational speed stored beforehand. If the answer is yes, the judging unit 12 judges in Step 102 that the engine is in the idling condition. Next, in Step 103 the operating unit 13 performs filtering of the time of a pulse to be output to the fuel injector 4, and outputs the pulse thereto. After completion of the present output, the program returns to START so as to repeat the procedure again. In this invention, a cycle of processing is repeated every 10 msec.

Figure 3:
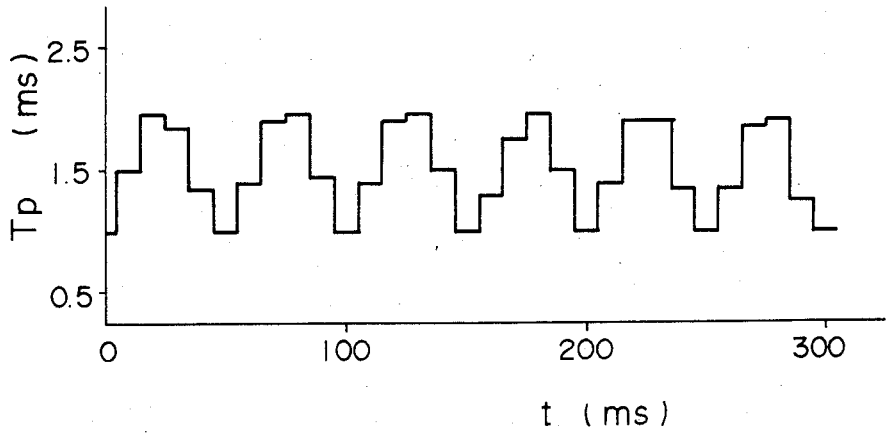
FIG. 3 PRIOR ART
FIG. 3 is a graph which shows variations in the engine idling rotational speed according to a known control apparatus.
Figure 4:
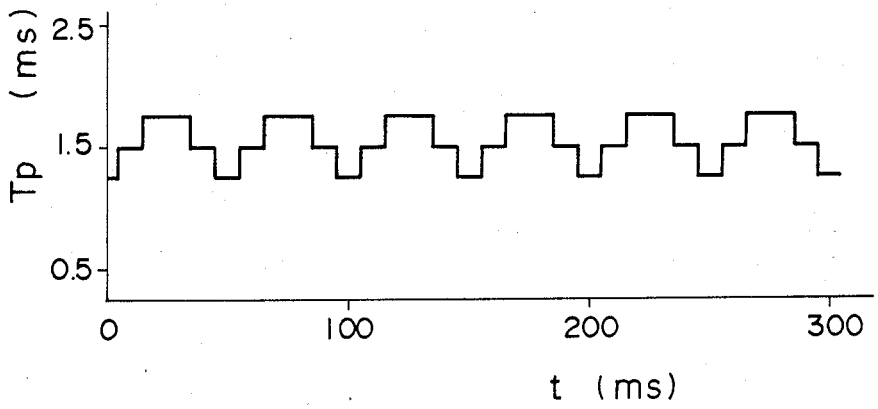
FIG. 4 is a graph which shows variations in the engine idling rotational speed according to the control system of this invention.

FIG. 4 shows variations in idling speed with the filter constant $\alpha$ set to 0.125. FIG. 3 shows variations in the idling speed of the prior art, that is, when filtering is performed on the detected values for the quantity Qa of air being sucked in. As can be seen from these graphs, variation in the idling speed can be reduced more effectively in the present invention than in the prior art.

As will be understood from the foregoing description, when calculating a pulse to be output to a fuel injector, filtering is performed on a value obtained by dividing the detected value for the quantity Qa of air being sucked in by the detected value for the rotational speed N of the engine, and the width of a pulse to be output to the fuel injector, i.e., the pulse time is obtained using the thus-filtered value. Thus it is possible to reduce the variations in the rotational speed of the engine at the time of idling.

What is claimed is:

1. An apparatus for controlling at the time of idling the rotational speed of an engine having an injector for injecting fuel in proportion to the width of an input pulse, comprising: a rotational speed sensor for cyclically detecting the rotational speed (N) of said engine; an airflow meter for cyclically detecting the quantity (Qa) of air being sucked into said engine; an idle switch for detecting the complete closing of a throttle valve; a judging means for judging that said engine is in the idling condition on the basis of the output of said idle switch and the output of said rotational speed sensor; and an operating means for cyclically outputting to said injector a fuel injection pulse having a width (Tp) obtained by the following expression on the basis of the output of said rotational speed sensor and the output of said airflow meter when said judging means has judged that said engine is in the idling condition:

$$Tp_1=k(Qa_1/N_1)\cdot\alpha+Tp_0\cdot(1-\alpha)$$

$Tp_1$: width of a pulse to be output at the present time $Tp_0$: width of a pulse which was output the previous time $Qa_1$: the presently detected value for the quantity of air being sucked in $N_1$: the presently detected value for the engine rotational speed $\alpha$: filter constant, $0<\alpha<1$ k: constant,

2. A control apparatus according to claim 1, wherein said judging means judges that said engine is in the idling condition when the output of said idle switch indicates that said throttle valve is fully closed and the value detected by said rotational speed sensor is smaller than a predetermined value.

3. A control apparatus according to claim 1, wherein said filter constant is 0.125.

* * * * *